US009465343B2

(12) United States Patent
Kamasuka

(10) Patent No.: US 9,465,343 B2
(45) Date of Patent: Oct. 11, 2016

(54) DEVICE, SYSTEM AND METHOD FOR DETECTING AND MANAGING TONER BOTTLE INSTALLATION HISTORY

(71) Applicants: Canon U.S.A., Inc., Melville, NY (US); Canon Information and Imaging Solutions, Inc., Melville, NY (US)

(72) Inventor: Atsushi Kamasuka, Matsudo (JP)

(73) Assignees: Canon Information and Imaging Solutions, Inc., Melville, NY (US); Canon U.S.A., Inc., Melville, NY (US)

( * ) Notice: Subject to any disclaimer, the term of this patent is extended or adjusted under 35 U.S.C. 154(b) by 0 days.

(21) Appl. No.: 14/879,519

(22) Filed: Oct. 9, 2015

(65) Prior Publication Data

US 2016/0103409 A1 Apr. 14, 2016

Related U.S. Application Data

(60) Provisional application No. 62/062,739, filed on Oct. 10, 2014.

(51) Int. Cl.
*G03G 15/00* (2006.01)

(52) U.S. Cl.
CPC ..... *G03G 15/553* (2013.01)

(58) Field of Classification Search
CPC .. G03G 15/553; G03G 15/556; G03G 15/55; G03G 2221/1663
See application file for complete search history.

(56) References Cited

U.S. PATENT DOCUMENTS

| | | | | |
|---|---|---|---|---|
| 7,330,672 | B2 | 2/2008 | Takahashi et al. | |
| 8,660,442 | B2 * | 2/2014 | Spink | G03G 15/502 399/24 |
| 2007/0229877 | A1 * | 10/2007 | Shima | G03G 15/55 358/1.14 |
| 2012/0148267 | A1 * | 6/2012 | Kawai | G03G 15/5079 399/8 |

FOREIGN PATENT DOCUMENTS

WO WO2015016881 A1 2/2015

* cited by examiner

*Primary Examiner* — Rodney Bonnette
(74) *Attorney, Agent, or Firm* — Canon U.S.A. Inc., IP Division

(57) ABSTRACT

An image processing device includes a detector for detecting at least one characteristic associated with a toner container installed in the image processing device. A counter is provided for selectively incrementing count data indicative of a number of pages having toner applied thereto that have been output by the image processing device. One or more processors and one or more computer-readable media coupled to the one or more processors are provided. The one or more computer-readable media storing instructions that, when executed by the one or more processors, cause the one or more processors to use the at least one characteristic detected by the detector and the count data to calculate a usage ratio representing an expected number of used toner bottles and an actual number of used toner bottles to determine whether the usage ratio exceeds a usage threshold, and communicating a result of the determination when the usage ratio exceeds the usage threshold.

18 Claims, 9 Drawing Sheets

DEVICE, SYSTEM AND METHOD FOR DETECTING AND MANAGING TONER BOTTLE INSTALLATION HISTORY

CROSS REFERENCE TO RELATED APPLICATIONS

This nonprovisional patent application claims priority from U.S. Provisional Patent Application Ser. No. 62/062,739 filed on Oct. 10, 2014, the subject matter of which is incorporated herein in its entirety.

BACKGROUND

1. Technical Field

This description generally relates to detecting and managing consumable parts of a device, and more specifically, to identifying when a premature replacement of a consumable part has occurred.

2. Background

Image processing devices are routinely deployed for both personal and commercial uses. Image processing devices may provide functionality for making photocopies, printing a document, scanning a document and generating an electronic document representing the scanned document, transmitting data over a network, accessing a database on a remote server, or other task. The cost and complexity of various image processing devices usually require a contractual relationship between a supplier/dealer and the commercial entity making use of the one or more image processing devices. The contractual relationship often governs service, maintenance, supplies for the machine whereby the supplier/dealer provides any supported needed to maintain the image processing device in working condition for the commercial entity. One type of service typically provided is the replacement of consumable parts of the image processing device. Consumable parts include any part(s) or object of the image processing device that alone, or in combination with other parts, enables the image processing device to accomplish any one or more of its intended functions. Examples of such include but are not limited to, toner bottles (or other containers), gears, rollers, grippers, trays, sensors, feeders, light emitters, optics, etc.

Of particular interest are toner bottles that supply the substrate which is affixed to a recording medium when an image processing device executes printing and/or photocopying operation. In addition to the economic consequence to the supplier/dealer who will typically provide replacement toner bottles to the commercial entity when needed, the use of toner bottles also has an environmental impact associated therewith. It is therefore desirable to generate a mechanism for identifying premature replacement of toner bottles within an image processing device in order to reduce the environmental and economic consequences that result from said premature replacement. A system, method and device according to invention principles remedies the defects associated with conventional systems.

SUMMARY

In one embodiment, an image processing device is provided. The image processing device includes a detector for detecting at least one characteristic associated with a toner container installed in the image processing device. A counter is provided for selectively incrementing count data indicative of a number of pages having toner applied thereto that have been output by the image processing device. One or more processors and one or more computer-readable media coupled to the one or more processors are provided. The one or more computer-readable media storing instructions that, when executed by the one or more processors, cause the one or more processors to use the at least one characteristic detected by the detector and the count data to calculate a usage ratio representing an expected number of used toner bottles and an actual number of used toner bottles to determine whether the usage ratio exceeds a usage threshold, and communicating a result of the determination when the usage ratio exceeds the usage threshold.

In another embodiment, a server in communication with at least two image processing devices via a network is provided. The server includes a communication interface that processes bidirectional communication with the at least two image processing devices. The server also includes one or more processors and one or more computer-readable media coupled to the one or more processors. The one or more computer-readable media store instructions that, when executed by the one or more processors, cause the one or more processors to, determine a collective usage ratio associated with the at least two image processing devices. The collective usage ratio is determined, based on data derived from each of the at least two image processing devices including at least one characteristic associated with a toner container to calculate a device usage ratio representing an expected number of used toner bottles and an actual number of used toner bottles for the device and calculating the collective usage ratio by aggregating each calculated device usage ratios to determine whether the collective usage ratio exceeds a usage threshold, and communicating a result of the determination when the collective usage ratio exceeds the usage threshold.

In another embodiment, an image processing device is provided. The device includes a detector detects at least one characteristic associated with a consumable container installed in the image processing device and a counter selectively increments count data indicative of a number of pages having a consumable applied thereto that have been output by the image processing device. The image processing device further includes one or more processors and one or more computer-readable storage media coupled to the one or more processors, the one or more computer-readable media storing at least one application including instructions that, when executed by the one or more processors, cause the one or more processors to calculate a usage ratio representing an expected number of used consumable bottles and an actual number of used consumable bottles using the at least one characteristic detected by the detector and the count data, determine whether the usage ratio exceeds a usage threshold, and communicate a result of the determination when the usage ratio exceeds the usage threshold.

In another embodiment, a method for determining excessive consumable usage executing on an image processing device is provided. The method comprises detecting at least one characteristic associated with a consumable container installed in the image processing device and selectively incrementing count data indicative of a number of pages having a consumable applied thereto that have been output by the image processing device. A usage ratio is calculated, the usage ratio represents an expected number of used consumable bottles and an actual number of used consumable bottles using the at least one characteristic detected by the detector and the count data and determines whether the usage ratio exceeds a usage threshold. The result of the determination is communicated when the usage ratio exceeds the usage threshold.

In further embodiments, one or more computer readable media that stores instructional code that, when read into memory of a computing device and upon execution of the instructional code in memory, transforms the computing device into a specific purpose computing device able to perform the functions set forth in the instructional code.

DESCRIPTION

Figure 1:
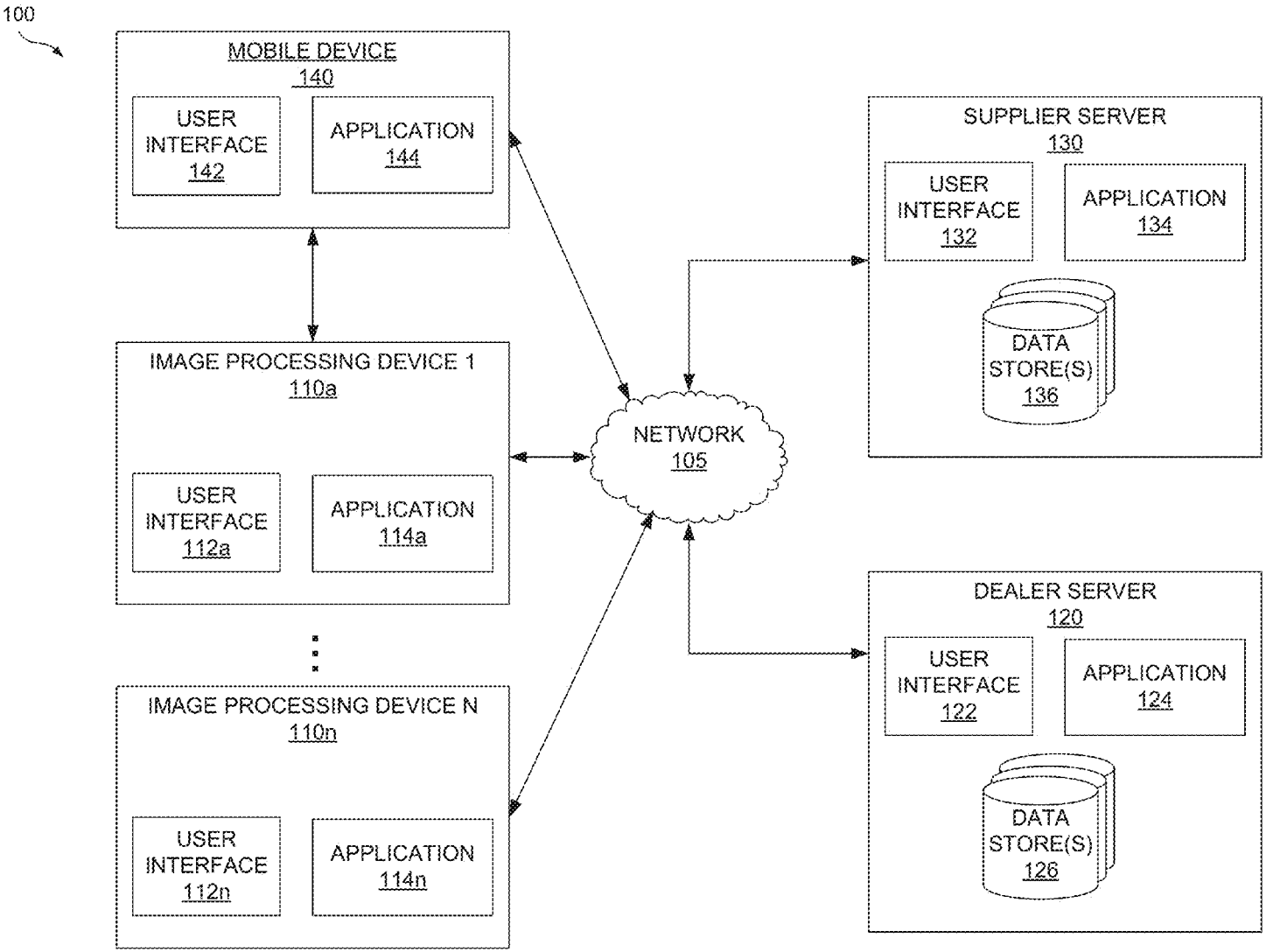
FIG. 1 illustrates an exemplary embodiment of a system for monitoring a consumable in an image processing device in accordance with invention principles.

The following disclosure describes certain explanatory embodiments. Other embodiments may include alternatives, equivalents, and modifications. Additionally, the explanatory embodiments may include several novel features, and a particular feature may not be essential to some embodiments of the devices, systems, and methods described herein.

The present system includes at least one image processing device used for at least one of printing and scanning functionality. The operations of the at least one image processing device is improved by the inclusion of a consumable monitoring algorithm that selectively ensures that respective types of consumables used by the image processing device are not replaced prematurely thereby increasing the environmental cost associated with operating the image processing device and ensure any dealer/supplier that provides service and/or parts for the image processing device are able to be justly compensated in the event that a consumable is replaced prior to the end of its intended lifecycle.

The following description focuses on the consumable being a toner bottle. However, persons skilled in the art could readily extend the principles associated with monitoring and detecting toner bottle replacement to any consumable part contained in the image processing device. Moreover, the description of a toner bottle is also used for purposes of example only and should be understood to include any type of container or reservoir formed from any type of material that may store material (e.g. toner) therein and be coupled to a photosensitive drum (or which includes a photosensitive drum) which affixes the material to a recording medium (e.g. paper or other substrate) during one of a printing or photocopying operation performed by the image processing device. For example, the container storing the material that will be affixed to a recording medium may include any of a bottle, cartridge, drum, consumable, toner unit or other printer part. Additionally, it should be understood that the consumable may be any container that retains material which can be controlled to be selectively output onto a recording medium via a printing algorithm to produce a predetermined pattern on the recording medium. The material stored in the container may exist as a liquid, powder, solid or gel. The material stored in the bottle (or other container) may be of a single color (e.g. black, red, yellow, cyan, blue, magenta, etc.) or may include multiple colors contained therein wherein each respective color can be individually controlled to be output in predetermined amounts onto a recording medium. In other embodiments, the image processing device may include a plurality of different toner bottles or containers, each including toner or ink of a different color which may be controlled via a printing algorithm to be selectively output, onto a recording medium individually or together, predetermined amounts of toner/ink thereby forming an image or pattern thereon.

FIG. 1 illustrates an example embodiment of a system for monitoring consumable consumption of at least one image processing device (referred to generally using reference numeral 110). FIG. 1 illustrates an example network environment 100 that includes at least one image processing device 110*a*-110*n* (where n>0), a first server 120 controlled by a dealer that has supplied an entity with the at least one image processing device 110*a*-110*n*, a second server controlled by a manufacturer of the at least one image processing device 110*a*-110*n* and at least one mobile device 140 able to selectively communicate directly or indirectly with the at least one image processing devices 110*a*-110*n*. Each of the components described herein are interconnected via a communications network 105 enabling one of bidirectional or unidirectional communication therebetween.

The network 105 that couples the components shown in FIG. 1 may be any suitable network that uses any suitable communications protocol for communicating data between the various components. For example, one or more portions of the network 105 may include an ad hoc network, an intranet, an extranet, a virtual private network (VPN), a local area network (LAN), a wireless LAN (WLAN), a wide area network (WAN), a wireless WAN (WWAN), a metropolitan area network (MAN), a portion of the Internet, a portion of the Public Switched Telephone Network (PSTN), a cellular telephone network, or a combination of two or more of these. The network 108 may include one or more networks. The network 105 may be a wireless communication network, a wired communication network or a combination of both.

While FIG. 1 depicts image processing devices 110*a*-110*n*, the following description will reference the components of image processing device 110*a*. However, it should be understood that the description of the components of image processing device 110*a* is applicable to any other image processing device 110*n* and need not be repeated. The image processing device 110*a* includes hardware, software, or both for providing the functionality of the image processing device 110*a*. In some embodiments, the image processing device 110*a* performs one or more steps of one or more methods described or illustrated herein. In some embodiments, the image processing device 110*a* provides functionality described or illustrated herein. In some embodiments, software running on the image processing device 110*a* performs one or more steps of one or more methods described or illustrated herein or provides functionality described or illustrated herein.

In some embodiments, the image processing device 110*a* includes hardware, software, or both for providing scanning functionality. For example, the image processing device 110*a* may include an image sensor or a camera for capturing an image. In some embodiments, the image processing device 110*a* scans a physical document to generate electrical signals which are converted to digital image data representing the scanned physical document. The image processing device 101 may convert the digital image data into an electronic document representing the scanned physical document and send the electronic document to a destination.

In other embodiments, the image processing device 110*a* includes hardware, software, or both for providing printing functionality. For example, the image processing device 110*a* may selectively receive electronic signals including data generated by one or more applications executing on a computing device (not shown) that is to be output via a printing function. The image processing device 110*a* may parse the data and control various components of a printing unit to acquire a substrate on which the data is to be printed and cause toner from a toner reservoir (bottle) to be affixed to the substrate, and output the substrate to the user.

In further embodiments, the image processing device 110*a* includes hardware, software or both for proving photocopying or other type of reproduction functionality. The reproduction functionality may include aspects of both the printing and scanning functionality described above whereby an image of an original physical document is captured and then reproduced for output to a further physical document.

The image processing device 110*a* includes the user interface 112*a*. The user interface 112*a* includes hardware, software, or both for providing the functionality of the user interface 112*a*. The user interface 112*a* may include an operation panel. The user interface 112*a* may output signals and receive input signals via the operation panel so as to facilitate interaction between a user and the image processing device 110*a*. An operation panel may include a hard key panel and/or a touch sensitive display. A user may provide user input operations via the hard key panel and/or the touch sensitive display to control the image processing device 110*a* via the operation panel. For example, the user may press one or more hard buttons to issue one or more commands. Further by way of example, a user may provide a touch input to an interface element displayed on the display to issue a command and/or to make a selection. Moreover, the image processing device 110*a* may output information to the user and issue requests by outputting images on a display.

In some embodiments, a browser may execute on the image processing device 110*a*. In some embodiments, the user interface 112*a* comprises information displayed by the browser. The browser may be a web browser such as MICROSOFT INTERNET EXPLORER or MOZILLA FIREFOX, and may be used to access a resource, such as a web page. The browser may enable a user to display and interact with text, images, form elements, or other information typically located on a web page served by a web server on the World Wide Web or a local area network. The browser may support various types of downloadable, executable, software modules, such as applets or plug-ins. For example, the browser may incorporate a virtual machine configured to execute a program, such as a JAVA applet, embedded in a web page accessed by the browser. The image processing device 110*a* may have various add-ons, plug-ins, or other extensions for use in or with the browser.

The image processing device 110*a* may include at least one application 114*a* comprising programs and related data. The application 114*a* may include a set of instructions representing one or more algorithms that are stored in a memory, storage device and/or computer-readable storage medium that are selectively executed by a processor which loads the set of instructions into active memory to perform the functionality detailed in the algorithm. In some embodiments, the application 114*a* executing on the image processing device 110*a* performs one or more steps of one or more methods described or illustrated herein or provides functionality described or illustrated herein. By way of example and not by way of limitation, programs of the application 114*a* may include instructions which, when executed by one or more processors, cause the one or more processors to perform one or more operations described with respect to FIGS. 5-11.

In some embodiments, the application 114*a* includes one or more programs for monitoring an amount of toner consumed by the image processing device over a predetermined period of time. In other embodiments, the application 114*a* selectively monitors a number of times a new toner bottle has been inserted into the image processing device. In other embodiments, the application monitors if, prior to the insertion of a new toner bottle, whether a signal indicating low toner had been generated by the image processing device 110*a*. The application 114*a* may selectively monitor a number of physical pages output by the image processing device and increment a counter indicative of the number of output pages. When the application determines a number of pages output reaches or exceeds a threshold, the application 114*a* may generate one or more alarms indicating that a level of toner remaining in the toner bottle is low thereby prompting a user to replace the toner bottle with a new one. The application 114*a* also advantageously uses the monitored data to identify when premature replacement of the toner bottle has occurred thereby resulting in a negative environmental impact stemming from over use and excess creation of waste material. The advantageous detection of premature replacement also enables a supplier and/or dealer that provide supplies for the image processing device 110*a* to be fully compensated by preventing overuse of toner.

In certain embodiments, application 114*a* may monitor one or more toner bottles installed in a particular image processing device 110*a* simultaneously and selectively determine if the one or more toner bottles installed therein has been prematurely replaced as discussed above. In other embodiments, the application may selectively connect to and interface with other image processing devices and receive data representing toner usage in the other image processing devices to selectively determine, across a fleet of image processing devices, whether the overall number of toner bottles installed across the fleet of image processing devices has exceeded a threshold level as determined by an expected output value identifying the number of toner bottles required to have produced the number of pages output by the fleet of image processing devices. Application 114*a* may further receive and process data representing the type of pages output (e.g. color image, black and white image, color text, black text, or combination thereof) by the fleet of image processing devices in calculating whether or not premature replacement of toner bottles has occurred in one or more image processing devices in the fleet.

In some embodiments, the application 114*a* executing on the image processing device 110*a* provides functionality for maintaining and accessing information in a data structure, which may be any suitable data structure for organizing data. For example, information associated with a user or process may be added as one or more entries into a data structure. The application 114*a* executing on the image processing device 110*a* may store and/or retrieve data in a memory or on a hard disk of the image processing device 110*a*. In some embodiments, the image processing device 110*a*, when executing the application 114*a*, may perform various operations with respect to a data store. Examples of operations include adding entries to a data store; deleting entries from a data store; modifying entries in a data store; searching for entries in a data store; and retrieving entries from a data store.

The application 114*a* executing on the image processing device 110*a* may provide functionality for generating information and providing the information to the user interface 112*a* of the image processing device 110*a*. The information may include text, images, form elements, files, executable programs, or other suitable information. The information provided by the application 114 may include content for display on a display of the image processing device 110.

The one or more server(s) 120, 130 each include hardware, software, or both for providing the functionality of the respective one or more server(s) 120, 130. In some embodiments, each of at least one of the one or more server(s) 120, 130 are unitary. In some embodiments, each of at least one of the one or more server(s) 120, 130 are distributed. At least one of the one or more server(s) 120, 130 may span multiple locations. At least one of the one or more server(s) 120, 130 may span multiple machines. In some embodiments, two or more of the one or more server(s) 120, 130 reside in a single computing system in any suitable manner. In some embodiments, at least one of the one or more server(s) 120, 130 is a file server. In some embodiments, at least one of the one or more server(s) 120, 130 is a web server. In some embodiments, at least one of the one or more server(s) 120, 130 is an application server. In some embodiments, at least one of the one or more server(s) 120, 130 is a database server.

A first exemplary type of server is a dealer server 120. The dealer server 120 is an exemplary type of computing device including specific hardware components that will be described hereinafter with respect to FIG. 3. In this embodiment, the dealer server 120 represents a computing system controlled by an entity that one of sold, leased, rented or otherwise provided the one or more image processing devices 110*a* to a user. In providing the one or more image processing devices 110*a*, a dealer may have one or more contractual agreements with the user operating the one or more image processing devices 110*a*. The one or more contractual agreements provide at least one term of use associated with operation of the image processing device 110*a* by the user. For example, the at least one term of use may include at least one of (a) a predetermined number of pages able to be output by a particular image processing device 110*a* over a predetermine time period; (b) a number of toner bottles provided for use by the image processing device 110*a* over a predetermined time period; (c) a predetermined schedule for servicing the image processing device 110*a*; (d) a total amount of toner bottles able to be consumed by all of the image processing devices provided by the dealer over a predetermined time period; (e) a predetermined amount of environmental waste attributable to toner bottles permitted over a predetermined amount of time; (f) a total amount of toner consumed based on the types of documents (e.g. text-based documents, graphical documents; photographs; etc.) output by the image processing device over a particular time period.

The user interface 122 of the dealer server 120 includes hardware, software, or both for providing the functionality of the user interface 122. The user interface 122 may be coupled to output data to a display (now shown) enabling a user of the server 120 to view information generated, stored or otherwise processed by the server 120. The user interface 112*a* may output signals and receive input signals via so as to facilitate interaction between a user and the server 120.

In some embodiments, a browser may execute on the server 120. In some embodiments, the user interface 122 comprises information displayed by the browser. The browser may be a web browser such as MICROSOFT INTERNET EXPLORER or MOZILLA FIREFOX, and may be used to access a resource, such as a web page. The browser may enable a user to display and interact with text, images, form elements, or other information typically located on a web page served by a web server on the World Wide Web or a local area network. The browser may support various types of downloadable, executable, software modules, such as applets or plug-ins. For example, the browser may incorporate a virtual machine configured to execute a program, such as a JAVA applet, embedded in a web page accessed by the browser. The server 120 may have various add-ons, plug-ins, or other extensions for use in or with the browser.

The dealer server 120 may include at least one application 124 comprising programs and related data. In some embodiments, the application 124 executing on the server 120 performs one or more steps of one or more methods described or illustrated herein or provide functionality described or illustrated herein. By way of example and not by way of limitation, programs of the application 124 may include instructions which, when executed by one or more processors, cause the one or more processors to perform one or more operations described with respect to FIGS. 5-11.

In some embodiments, the application 124 includes one or more programs for monitoring an amount of toner consumed by the image processing device over a predetermined period of time. In other embodiments, the application 124 selectively monitors a number of times a new toner bottle has been inserted into the image processing device. In other embodiments, the application monitors if, prior to the insertion of a new toner bottle, whether a signal indicating low toner had been generated by the image processing device 110*a*. The application may selectively monitor a number of physical pages output by one or more image processing devices and received counter data generated by a counter of respective image processing devices to monitor a number of output pages. The application 124 may selectively calculate whether an amount of toner used by respective ones of the image processing devices is excessive when compared to a permitted amount of toner according to an agreement between the dealer and to whom the dealer has provided the one or more image processing devices 110*a*. When the application 124 determines that one or more image processing devices has used an excessive amount of toner, the application may generate a record indicative of excessive usage that may be used to enforce one or more terms of use of a contractual relationship between the dealer and entity. The application 124 also advantageously uses the monitored data to identify when premature replacement of the toner bottle has occurred thereby resulting in a negative environmental impact stemming from over use and excess creation of waste material. The advantageous detection of premature replacement also enables a supplier and/or dealer that provide supplies for the image processing device 110*a* to be fully compensated by preventing overuse of toner.

In some embodiments, the application 124 executing on the server 120 provides functionality for maintaining and accessing information in a data structure 126, which may be any suitable data structure for organizing data. For example, information associated with a user or process may be added as one or more entries into a data structure 126. The application 124 executing on the server 120 may store and/or retrieve data in a memory or on a hard disk of the server 120. In some embodiments, the server 120, when executing the application 124, may perform various operations with respect to a data store 126. Examples of operations include adding entries to a data store; deleting entries from a data store; modifying entries in a data store 126; searching for entries in a data store 126; and retrieving entries from a data store 126.

A second type of server 130 is a supplier server that is coupled to every image processing device 110 that was manufactured by the supplier. The supplier server 130 also includes a user interface 132, at least one application 134 and at least one data store 136. The user interface 132 is similar in nature and scope as the user interface 122 of server 120 and the description of which is incorporated herein by reference and need not be repeated. The difference between supplier server 130 and dealer server 120 will be discussed with respect to functionality of application 134 executing on server 130. Application 134 executing on server 130 selectively receives event information from each image processing device 110*a* coupled thereto by network 105. Each time an event is detected by the image processing device 110*a*, the application 134 is configured to selectively receive data indicative of the event and create one or more records in the data store 136 reflecting the occurrence of the event. As used herein, an exemplary event may include at least one of (a) counter data associated with a particular image processing device at a given time; (b) generation of a "toner low" signal by the image processing device; (c) determination that a toner bottle of a particular image processing device has been replaced; (d) determination that a same toner bottle has been reinstalled in a particular image processing device; and (e) determination that a toner bottle is either an authorized (genuine) toner bottle or unauthorized (non-genuine) toner bottle.

The application 134 executing on supplier server 130 further receives requests from dealer server 120 to query whether certain events have occurred. The application 134 provides event data for image processing devices that were requested by dealer server 120 in order to calculate whether or not the events that occurred resulted in a violation of the terms of use between the dealer and the entity.

A mobile device 140 including a user interface 142 and application 144 may also communicate with any one of the components described above in FIG. 1 enabling a user of the mobile device to avail themselves of data generated by the respective component. The mobile device may be any portable computing device including a laptop, tablet, smartphone, etc.

Figure 2:
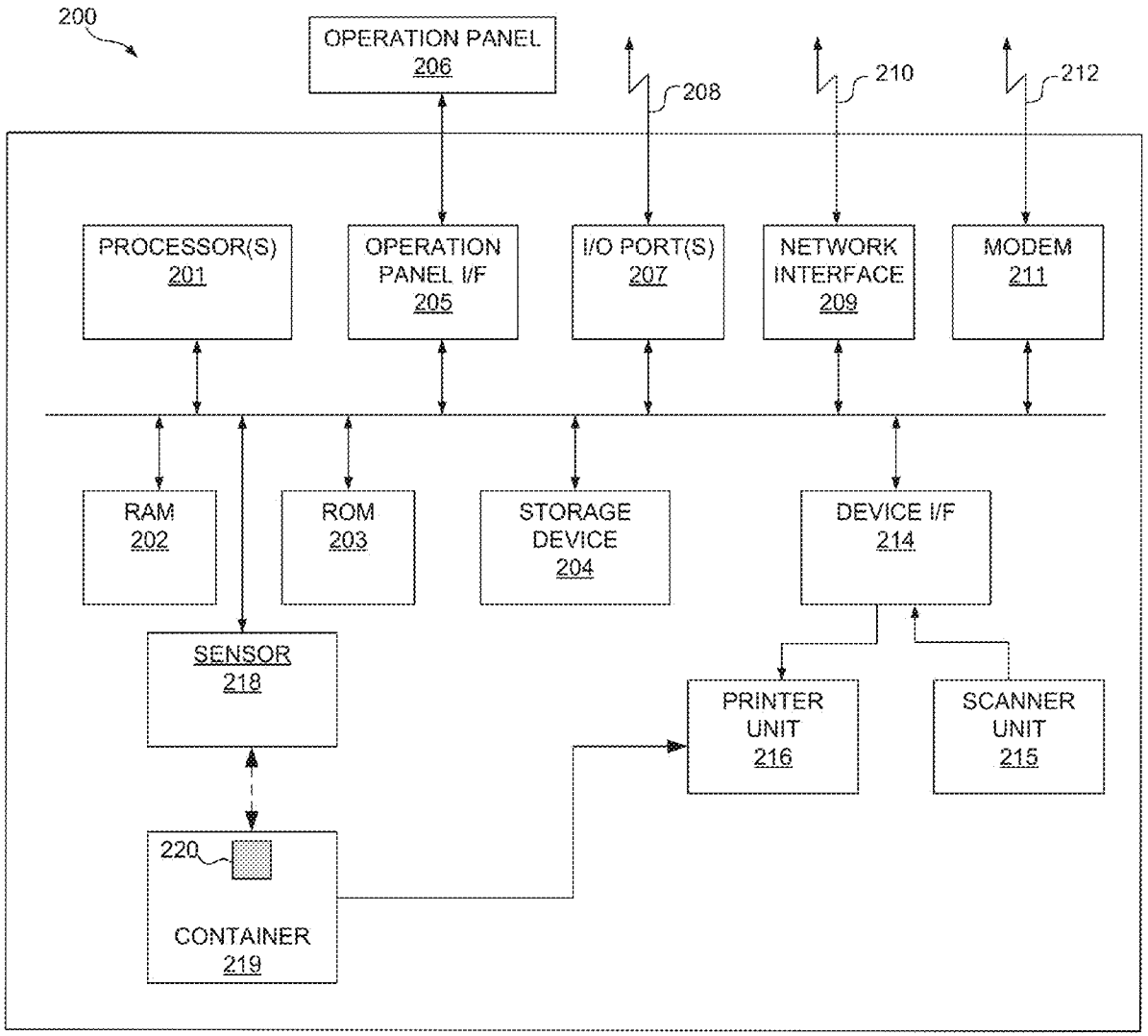
FIG. 2 illustrates a block diagram of an exemplary image processing device in accordance with invention principles.

FIG. 2 illustrates an example image processing device 200. In some embodiments, the image processing device 110*a* of FIG. 1 comprises the image processing device 200. The image processing device 200 of FIG. 2 is a multifunction peripheral having a scanning function in addition to printing, copying and other functions. However, it will be understood that various other implementations of an image processing device are within the scope of the present invention. For example, various components, modules, functions, and/or configurations of the image processing device 200 of FIG. 2 could be combined, deleted, or modified to form further implementations. Further by way of example, in some embodiments, other devices (for example, a standalone scanner, fax machine, or other device with scanning capabilities) and/or computing systems (for example, a computer connected to a scanner) may be implemented as the image processing device 200.

In some embodiments, the image processing device 200 performs one or more operations described herein. In some embodiments, the image processing device 200 provides functionality described herein. In some embodiments, software running on the image processing device 200 performs one or more operations described herein.

The image processing device 200 includes one or more processor(s) 201. The processor(s) 201 include a central processing unit (CPU) that performs overall control functions for the image processing device 200. The CPU uses a random access memory (RAM) 202 as a work area while executing instructions. The CPU executes instructions of various programs stored in one or more memory devices. For example, the CPU executes programs stored in a read only memory (ROM) 203 and in a storage device 204.

In some embodiments, the processor(s) 201 include one or more processors in addition to the CPU. By way of example, the processor(s) 201 may include one or more general-purpose microprocessor(s), application-specific microprocessor(s), and/or special purpose microprocessor(s). Additionally, in some embodiments the processor(s) 201 may include one or more internal caches for data or instructions.

The processor(s) 201 provide the processing capability required to execute an operating system, application programs, and various other functions provided on the image processing device 200. The processor(s) 201 perform or cause components of the image processing device 200 to perform various operations and processes described herein, in accordance with instructions stored in one or more memory devices.

The RAM 202 is used as a work area when the processor(s) 201 execute various instructions, such as those making up computer programs stored in the ROM 203 and/or the storage device 204. The RAM 202 may be used as a temporary storage area for various data, including input image data. The RAM 202 may be used as a cache memory. In some embodiments, the RAM may be dynamic RAM (DRAM) or static RAM (SRAM).

The ROM 203 stores data and programs having computer-executable instructions for execution by the processor(s) 201. In some embodiments, the ROM 203 is a boot ROM, storing instructions for the booting process. In some embodiments, the ROM 203 may be flash memory.

The storage device 204 stores application data, program modules and other information. One or more program modules stored in the storage device 204 are configured to cause various operations and processes described herein to be executed. In some embodiments, the application 114 resides on the storage device 204 and executes on the image processing device 200.

The storage device 204 also stores other programs and data to be processed. For example, the storage device 204 stores an operating system including programs and data for managing hardware and software components of the image processing device 200. Applications on the image processing device 200 may utilize the operating system to perform various operations. The storage device 204 may further store other programs and/or drivers that enable various functions of the image processing device 200, graphical user interface (GUI) functions, and/or processor functions. The storage device 204 may also store data files including, for example, image data, user data, configuration information, GUI components, such as graphical elements or templates, or other data required by the image processing device 200.

In some embodiments, the image processing device 200 may include other storage media. By way of example, and not by way of limitation, the storage media may include a floppy disk drive, flash memory, an optical disc, a magneto-optical disc, magnetic tape, or a Universal Serial Bus (USB) drive or a combination of two or more of these. Where appropriate, the storage media may include removable or fixed media. Where appropriate, the storage media may be internal or external to the image processing device 200. In some embodiments, the storage media is non-volatile, solid-state memory. The storage media may take any suitable physical form. For example, the storage media may be in the form of one or more removable blocks, modules, or chips. The computer-readable storage medium need not be one physical memory device, but can include one or more separate memory devices.

An operation panel interface 205 provides output signals to and receives input signals from an operation panel 206. Regarding the output signals, the operation panel interface 205 provides GUI data to the operation panel 206 for display on a liquid crystal display (LCD). Regarding the input signals, the operation panel interface 205 receives input signals based on user input operations at the operation panel 206 and relays the input signals to the processor(s) 1201. In some embodiments, the operation panel 206 includes a touch sensitive element operable to receive user input operations or commands based on the touching of graphical objects displayed on the LCD. In some embodiments, the operation panel 206 includes a hard key panel.

The image processing device 200 includes one or more input/output (I/O) port(s) 207. The I/O port(s) 207 may include any suitable interface type such as a universal serial bus (USB) port, FireWire port (IEEE-1394), serial port, parallel port, or AC/DC power connection port. The I/O port(s) 207 enable one or more external device(s) 208 to communicate with the image processing device 200 when the external device(s) 208 is/are connected to the I/O port(s) 207. Examples of external devices 208 include a near field communication (NFC) interface (for example, an NFC reader), a smart card reader, radio-frequency identification (RFID) reader, device for detecting biometric information, a keyboard, keypad, sensor(s), a combination of two or more of these, or other suitable device.

A network interface 209 includes hardware, software, or both providing one or more interfaces for communication (such as, for example, packet-based communication) between the image processing device 200 and one or more other computing systems or one or more networks 210. As an example and not by way of limitation, the network interface 209 may include a network interface card (NIC) or a network controller for communicating with an Ethernet or other wire-based network or a wireless NIC (WNIC) or wireless adapter for communicating with a wireless network, such as a WI-FI network. This disclosure contemplates any suitable network 210 and any suitable network interface 209 for it. As an example and not by way of limitation, the image processing device 200 may communicate with an ad hoc network, a personal area network (PAN), a local area network (LAN), a wide area network (WAN), a metropolitan area network (MAN), or one or more portions of the Internet or a combination of two or more of these. One or more portions of one or more of these networks 210 may be wired or wireless. As an example, the image processing device 200 may communicate with a wireless PAN (WPAN) (such as, for example, a BLUETOOTH WPAN), a WI-FI network, a WI-MAX network, or other suitable wireless network or a combination of two or more of these. The image processing device 200 may include any suitable network interface 209 for any of these networks 210, where appropriate.

A modem 211 modulates/demodulates image data and control signals. The modem 211 is connected to the Public Switched Telephone Network (PSTN) 212 and performs input/output of information between the image processing device 200 and the PSTN 212. By way of example, the modem 211 may send/receive facsimile communications.

A system bus 213 interconnects various components of the image processing device 200 thereby enabling the transmission of data and execution of various processes. The system bus 213 may include one or more types of bus structures including a memory bus or memory controller, a peripheral bus, and a local bus using any of a variety of bus architectures.

The device interface 214 is connected to the scanner unit 215 and to the printer unit 216. The device interface 214 performs synchronous/asynchronous conversion of image data. The scanner unit 215 includes a light source and an image sensor. The scanner unit 215 may include a glass platen and/or an automatic document feeder (ADF). In operation, the light source illuminates a physical document positioned on the glass platen or fed by the ADF. Light reflected by the physical document reaches the image sensor, and the image sensor converts the light into electrical signals. In some embodiments, the scanner unit 215 includes an optical system (for example, mirrors, lens) that directs the light to the image sensor. After the image sensor generates the electrical signals, an analog-to-digital converter converts the electrical signals to digital image data representing the scanned physical document. The scanner unit 215 then outputs the digital image data to one or more other components of the image processing device 200 via the device interface 214.

The printer unit 216 is an image output device for printing on a sheet an image corresponding to image data. In response to a print command received at the image processing device 200, the printer unit 216 receives image data via the device interface 214 and outputs to a sheet an image corresponding to the image data.

The image processing device 200 may also include at least one sensor 218 that senses data associated with at least one toner container 219 (e.g. toner bottle) installed therein. While the depiction in FIG. 2 shows one sensor 218 for sensing data associated with one container 219, this is shown for purposes of example only and it should be understood that a plurality of sensors and/or a plurality of containers 219 may be included in the image processing device 200. In one embodiment, the container 219 includes a consumable indicator 200 including at least a unique identifier associated therewith that may be used to track or otherwise follow the container 219 from its original point of origin through delivery to an owner of an image processing device 200 and installation into one or more image processing devices. The indicator 220 may be any of a tag, label and/or be a microchip. The indicator 220 may include container identification data encoded therein that provides information that may be selectively decoded upon being sensed by the sensor 218. In certain embodiments, the sensor 218 may be one of an optical sensor, electrical sensor and/or a radio frequency sensor. It should be noted that the types of indicators 220 and the sensors 218 able to sense data originating from the indicators 220 are described for purposes of example only and any type of sensor-identifier pair may be used.

In exemplary operation, in one embodiment, the sensor 218 senses a presence or absence of a container 219 in the image processing device 200. In response to sensing that a container 219 is present, the sensor 218 may sense data encoded within the indicator 220 associated with the container 219. In one example, the indicator 220 may be a two-dimensional code (e.g. barcode, QR code, etc.) which may be read (e.g. scanned) by an optical sensor 218. Upon reading the data contained in the barcode, the image processing device 200 may use the sensed container identification data in the manner discussed hereinbelow to monitor and selectively determine if any premature replacement of the container 219 has occurred. In another example, the indicator 220 may be a microchip that emits radio waves at a predetermined frequency which may be sensed by a radio frequency sensor 218. The emitted waves may include identification data that identifies the particular container 219 which may then be used in the manner discussed hereinbelow to monitor and selectively determine if any premature replacement of the container 219 has occurred.

In other embodiments, the image processing device 200 may include a number of sensors 218 equivalent to the number of containers 219 for toner according to the specifications of the image processing device 200. For example, an image processing device 200 may be capable of printing in color and black and white and thus may require one or more containers 219 having black toner as well as one or more containers 219 including various colored toner. Thus, in this embodiment, there may be a sensor 218 for each container 219 having its own unique indicator 220 that is able to sense container identification data for each in order to determine if any premature toner replacement for any of the installed containers has occurred.

In another embodiment, the sensor 218 may sense one or more signals emitted by the indicator 220 of the container 219 identifying one or more characteristics describing the container 219 and/or the toner retained therein. Characteristics may include at least one of (a) date; (b) time; (c) number of expulsions of toner onto a recording medium; (d) a level of toner remaining in the container; (e) a low toner signal indicative that an amount of toner remaining has fallen below a predetermined threshold level; and (f) a zero toner signal indicating that no toner remains in the container. In one embodiment, the characteristic signals may be electrically communicated from one or more contacts on the container 219 that are in communication with one or more contacts of the sensor 218. In another embodiment, the characteristic signals may be communicated via any one of radio frequency transmission, Bluetooth, NFC or the like for receipt by a corresponding reading unit of the sensor 218.

Figure 3:
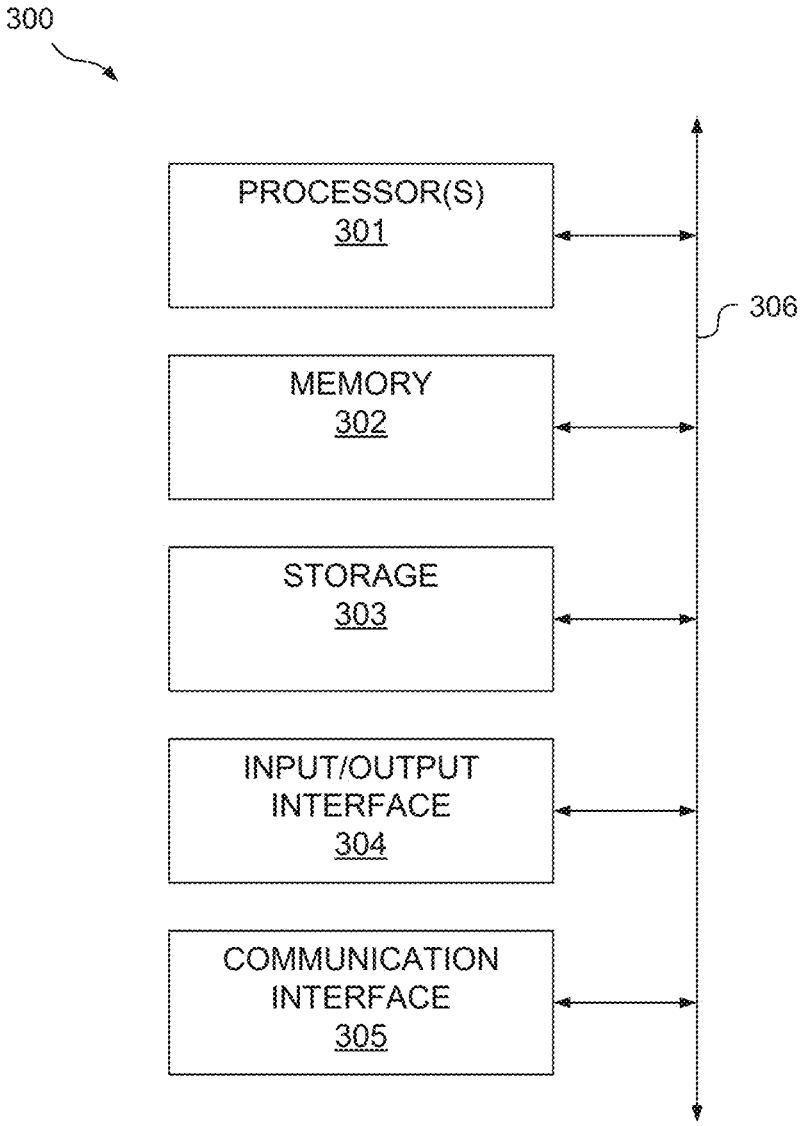
FIG. 3 illustrates a block diagram of an exemplary computing device in accordance with invention principles.

FIG. 3 illustrates an example computing system 300. According to various embodiments, all or a portion of the description of the computing system 300 is applicable to all or a portion of one or more of the image processing device 110, the first server 120, the second server 130 and/or the mobile computing device 140.

The term computing system as used herein includes but is not limited to one or more software modules, one or more hardware modules, one or more firmware modules, or combinations thereof, that work together to perform operations on electronic data. The physical layout of the modules may vary. A computing system may include multiple computing devices coupled via a network. A computing system may include a single computing device where internal modules (such as a memory and processor) work together to perform operations on electronic data. Also, the term resource as used herein includes but is not limited to an object that can be processed at a computing system. A resource can be a portion of executable instructions or data.

In some embodiments, the computing system 300 performs one or more steps of one or more methods described or illustrated herein. In some embodiments, the computing system 300 provides functionality described or illustrated herein. In some embodiments, software running on the computing system 300 performs one or more steps of one or more methods described or illustrated herein or provides functionality described or illustrated herein. Some embodiments include one or more portions of the computing system 300.

The computing system 300 includes one or more processor(s) 301, memory 302, storage 303, an input/output (I/O) interface 304, a communication interface 305, and a bus 306. The computing system 300 may take any suitable physical form. For example, and not by way of limitation, the computing system 300 may be an embedded computer system, a system-on-chip (SOC), a single-board computer system (SBC) (such as, for example, a computer-on-module (COM) or system-on-module (SOM)), a desktop computer system, a laptop or notebook computer system, an interactive kiosk, a mainframe, a mesh of computer systems, a mobile telephone, PDA, a server, a tablet computer system, or a combination of two or more of these.

The processor(s) 301 include hardware for executing instructions, such as those making up a computer program. The processor(s) 301 may retrieve the instructions from the memory 302, the storage 303, an internal register, or an internal cache. The processor(s) 301 then decode and execute the instructions. Then, the processor(s) 301 write one or more results to the memory 302, the storage 303, the internal register, or the internal cache. The processor(s) 301 may provide the processing capability to execute the operating system, programs, user and application interfaces, and any other functions of the computing system 300.

The processor(s) 301 may include a central processing unit (CPU), one or more general-purpose microprocessor(s), application-specific microprocessor(s), and/or special purpose microprocessor(s), or some combination of such processing components. The processor(s) 301 may include one or more graphics processors, video processors, audio processors and/or related chip sets.

In some embodiments, the memory 302 includes main memory for storing instructions for the processor(s) 301 to execute or data for the processor(s) 301 to operate on. By way of example, the computing system 300 may load instructions from the storage 303 or another source to the memory 302. During or after execution of the instructions, the processor(s) 301 may write one or more results (which may be intermediate or final results) to the memory 302. One or more memory buses (which may each include an address bus and a data bus) may couple the processor(s) 301 to the memory 302. One or more memory management units (MMUs) may reside between the processor(s) 301 and the memory 302 and facilitate accesses to the memory 302 requested by the processor(s) 301. The memory 302 may include one or more memories. The memory 302 may be random access memory (RAM).

The storage 303 stores data and/or instructions. As an example and not by way of limitation, the storage 303 may include a hard disk drive, a floppy disk drive, flash memory, an optical disc, a magneto-optical disc, magnetic tape, or a Universal Serial Bus (USB) drive or a combination of two or more of these. In some embodiments, the storage 303 is a removable medium. In some embodiments, the storage 303 is a fixed medium. In some embodiments, the storage 303 is internal to the computing system 300. In some embodiments, the storage 303 is external to the computing system 300. In some embodiments, the storage 303 is non-volatile, solid-state memory. In some embodiments, the storage 303 includes read-only memory (ROM). Where appropriate, this ROM may be mask-programmed ROM, programmable ROM (PROM), erasable PROM (EPROM), electrically erasable PROM (EEPROM), electrically alterable ROM (EAROM), or flash memory or a combination of two or more of these. The storage 303 may include one or more memory devices. One or more program modules stored in the storage 303 may be configured to cause various operations and processes described herein to be executed.

The I/O interface 304 includes hardware, software, or both providing one or more interfaces for communication between the computing system 300 and one or more I/O devices. The computing system 300 may include one or more of these I/O devices, where appropriate. One or more of these I/O devices may enable communication between a person and the computing system 300. As an example and not by way of limitation, an I/O device may include a keyboard, keypad, microphone, monitor, mouse, speaker, still camera, stylus, tablet, touch screen, trackball, video camera, another suitable I/O device or a combination of two or more of these. An I/O device may include one or more sensors. In some embodiments, the I/O interface 304 includes one or more device or software drivers enabling the processor(s) 301 to drive one or more of these I/O devices. The I/O interface 304 may include one or more I/O interfaces.

The communication interface 305 includes hardware, software, or both providing one or more interfaces for communication (such as, for example, packet-based communication) between the computing system 300 and one or more other computing systems or one or more networks. As an example and not by way of limitation, the communication interface 305 may include a network interface card (NIC) or a network controller for communicating with an Ethernet or other wire-based network or a wireless NIC (WNIC) or wireless adapter for communicating with a wireless network, such as a WI-FI network. This disclosure contemplates any suitable network and any suitable communication interface 305 for it. As an example and not by way of limitation, the computing system 300 may communicate with an ad hoc network, a personal area network (PAN), a local area network (LAN), a wide area network (WAN), a metropolitan area network (MAN), or one or more portions of the Internet or a combination of two or more of these. One or more portions of one or more of these networks may be wired or wireless. As an example, the computing system 300 may communicate with a wireless PAN (WPAN) (such as, for example, a Bluetooth WPAN or an ultra wideband (UWB) network), a WI-FI network, a WI-MAX network, a cellular telephone network (such as, for example, a Global System for Mobile Communications (GSM) network), or other suitable wireless network or a combination of two or more of these. The computing system 300 may include any suitable communication interface 305 for any of these networks, where appropriate. The communication interface 305 may include one or more communication interfaces 305.

The bus 306 interconnects various components of the computing system 300 thereby enabling the transmission of data and execution of various processes. The bus 306 may include one or more types of bus structures including a memory bus or memory controller, a peripheral bus, and a local bus using any of a variety of bus architectures.

The operation of the consumable monitoring system according to invention principles will now be described with respect to FIG. 4 which provides a timeline of events used by the system to generate the desired information and FIGS. 5-11 provide algorithms and routines associated with various applications that are stored in memory (RAM and/or ROM) that are executed by one or more processors to complete the monitoring steps according to invention principles.

Figure 4:
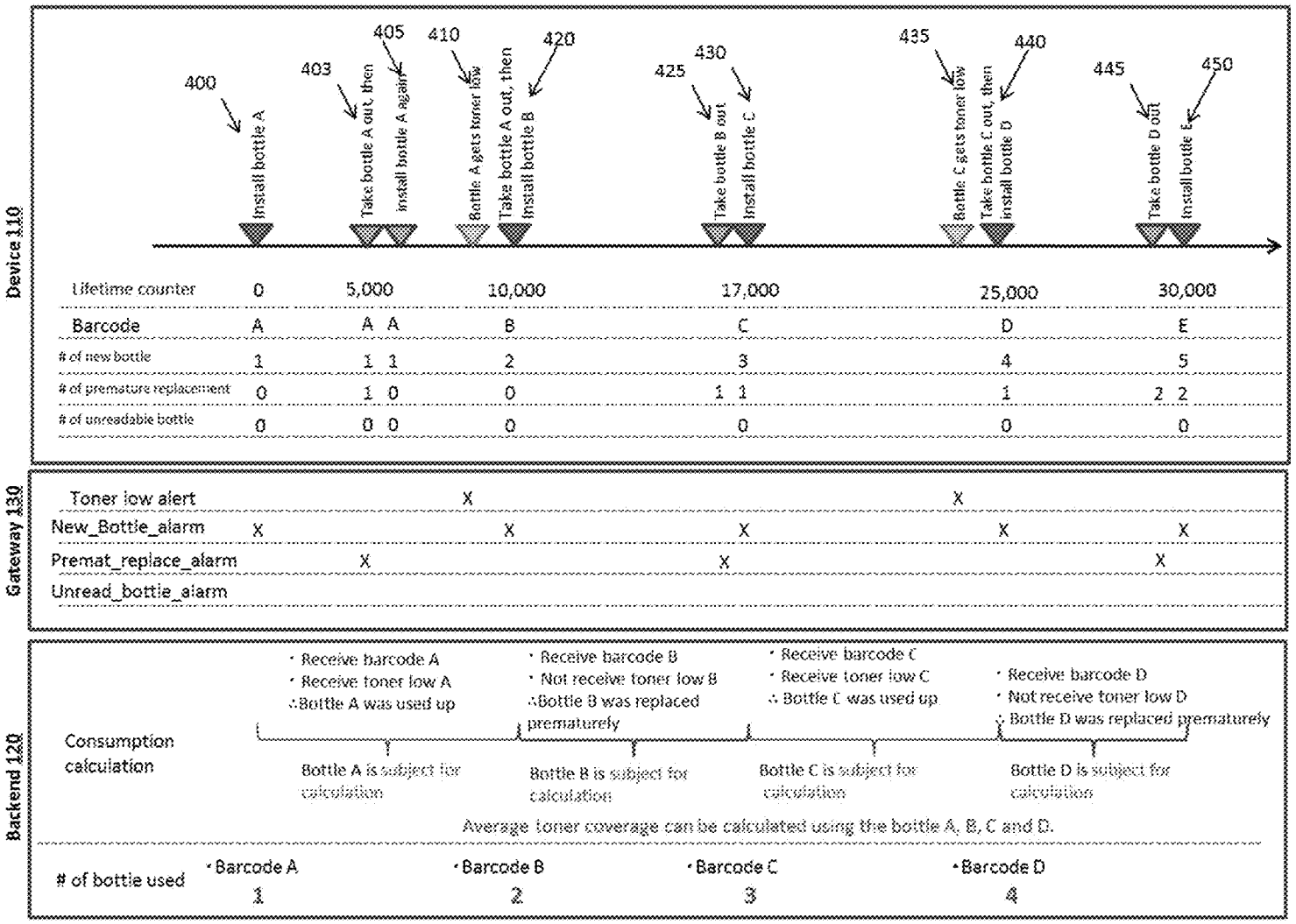
FIG. 4 illustrates a timeline detailing the consumable monitoring process in accordance with invention principles.

The timeline shown in FIG. 4 represents three distinct components of the system that store various data used by respective devices in determining whether or not an excessive amount of toner has been used by one or more image processing device 110. The system includes image processing device 110, a gateway server 130 (supplier server) and backend server 120 (dealer server).

In operation, the application 114 executing on image processing device 110 detects event 400 indicating that a first toner bottle (Toner bottle A) has been installed. For purposes of example to illustrate invention principles, event 400 will reference a first installation of a toner bottle prior to any use of the image processing device 110. At event 400, application 114 checks a counter value of an output page counter and sets the current value of the counter as the base value. In this example, the counter value is set equal to 0. This serves as a base value against which excessive use of toner may be calculated. Additionally, application 114 also causes a sensor of the image processing device to sense a consumable indicator associated with the consumable that has been installed at event 400. The consumable indicator may be a barcode or other electronic identifier associated with a toner bottle that was installed in image processing device during event 400. Upon reading the consumable indicator, a record of the indicator is created in memory of the image processing device. This is shown herein as "barcode A". The application further uses the event data 400 to increment a number of new toner bottles installed in the image processing device 110 (# of new bottle=1). The application 114 further causes event data 400 to be communicated via network 105 (FIG. 1) to gateway server 130 in order to update a data record associated with the particular image processing device 110. The event data 400 communicated to gateway server is represented by the "x" in the row labeled "new_bottle_alarm". The description merely represents a unique identifier stored in the data store of gateway 130 that is associated with a new toner bottle installation event.

A second event 403 is generated when the application 114 detects that toner bottle A has been removed from the image processing device 110 and stores the counter value at the time of event 403 (counter=5000, indicating that 5000 pages were output prior to the occurrence of event 403). At the time of event 403, the application 114 further determines whether or not an event indicating "toner low" has been generated by the image processing device 110. Because there has been no "toner low" event, the application 114 increments a premature replacement value counter (# of premature replacement=1). Data indicating the premature replacement event is communicated to the gateway server 130 and the data store of the gateway server 130 is updated to reflect that a premature replacement event has occurred for the particular image processing device 110 as shown by the "x" in the row labeled "premat_replace_alarm". This identifier is also simply a unique identifier that identifies a premature toner replacement event in the data store of the gateway server 130. At this time, Toner Bottle A is reinstalled as shown in event 405. The image processing device, repeats the toner bottle detection routine to sense the identifier associated with the toner bottle installed in the machine. However, instead of replacing toner bottle A with a different toner bottle having a different indicator associated therewith, the application 114 determines that toner bottle A was reinstalled in image processing device 110. Because Toner Bottle A was previously installed, this installation does not qualify as a "new bottle installation". Thus, the counter associated with tracking new bottles is caused to remain at "1". The application 114 may query whether the identifier of the reinstalled Toner Bottle A matches an identifier of a previously installed toner bottle. Additionally the application 114 may query whether or not a toner low signal had been generated by the image processing device prior to the reinstallation of Toner Bottle A, the application causes the premature replacement counter to be decremented from "1" to "0" because the same toner bottle was reinstalled prior to issuance of a toner low signal by the image processing device.

Operation of the image processing device 110 continues whereby the application 114 monitors operation for a toner low signal. In one embodiment, the toner low signal may be generated by the application which continually monitors the counter value. When the counter value exceeds a predetermined threshold, the application 114 initiates a toner low signal. In another embodiment, the toner low signal may be generated by the application 114 which receives input from a toner bottle sensor of the image processing device which senses an amount (or level) of toner that remains in the toner bottle. The toner bottle sensor will generate the toner low input message upon determining that an amount of toner in the toner bottle has fallen below a predetermine threshold toner level. In response to receiving a toner low signal, event 410 is generated, recorded and communicated to the gateway server 130 to update the toner low event record for the image processing device 110 as indicated by the "x" in the row labeled "toner low alert". The "toner low alert" is merely a unique identifier that identifies a that a toner low signal has been detected that is stored in the data store of the gateway server 130

At a point in time after event 410, the toner bottle A is replaced due to depletion of the toner therein. This results in the generation of event 420 indicating replacement of toner bottle A with Toner Bottle B. The application 114 automatically senses the consumable identifier of toner bottle B and compares the sensed identifier with previously stored identifiers. If no match is detected, the application updates the toner bottle history information in the image processing device and increments the number of new toner bottles installed in the image processing device 110 from "1" to "2". Additionally, the counter value at event 420 is stored in memory of the device 110. Event data from event 420 is communicated to the gateway server 130 to update the record in the data store associated with the image processing device 110 to reflect that a new toner bottle installation has occurred ("x" in the row labeled "new_bottle_alarm").

The timeline of FIG. 4 shows additional events that occur during a predetermined period that allow for determining whether or not the amount of toner used during the predetermined time period is excessive. Event 425 represents that application determining that toner bottle B has been removed. Upon detection of the removal, the application queries whether or not a toner low signal was generated and, upon determining that no such signal was generated by the image processing device, the application 114 causes the premature replacement counter to be incremented to "1" and communicate to the gateway server 130 data indicative of the premature replacement. Event 430 indicates that a further new toner bottle C has been installed in the image processing device 110 as indicated by incrementing the number of new toner bottle counter from "2" to "3". A counter value at the time of event 430 is updated and data indicating the new installation is communicated to the gateway server 130.

A further toner low signal issued by the image processing device is detected by application 114 resulting in the generation of events 435. This toner low signal may be generated in response to receiving input from the toner sensor indicating that toner level in Toner Bottle C has fallen below a predetermined toner level. Alternatively, the toner low signal may be generated by application 114 after determining that the counter value between the installation of toner bottle C and the current counter value has reached a predetermined threshold. Event 440 indicates the replacement of toner bottle C with toner bottle D. The number of new toner bottle values is incremented from "3" to "4" while the number of premature replacement remains at "1" because event 440 occurred after the toner low signal in event 435. This data is then communicated to the gateway server to update the records associated with image processing device 110.

Event 445 is generated by the application upon detecting removal of toner bottle D. during event 445, the premature replacement counter is incremented from "1" to "2" because the application 114 determined that no toner low signal had been generated in advance of the removal of toner bottle D. Data indicative of the updated premature replacement value is communicated to gateway server 130. Installation of toner bottle E is detected by application 114 which generates event 450. At event 450, the new toner bottle counter is incremented from "4" to "5" because the consumable identifier of the newly installed toner bottle is Toner Bottle E which the application determines has not been previously installed in the image processing device. Data associated with event 450 is communicated to gateway server 130 and the respective alarms are updated in the data store thereof in the manner discussed above.

In another embodiment, there exists a possibility that a toner bottle installed at a given time includes a consumable identifier that is not recognized by the image processing device. For example, this may occur when a user installs a non-genuine (e.g. not provided from the manufacturer, supplier, or dealer of the image processing device) toner bottle into the image processing device. In this instance, the application 114 may determine that the consumable identifier of the installed toner bottle is unreadable or otherwise unrecognizable. The application 114 may increment a counter for counting a number of unreadable bottles (e.g. an unreadable bottle counter). Upon incrementing the unreadable bottle counter, an event indicative of installation of an unreadable bottle is generated and data representing the event is communicated to gateway server 130 accordingly. By including a number of installation of non-genuine toner bottles, the application 114 may advantageously exclude these events and total toner usage associated with the non-genuine bottle to improve the calculation as to whether or not the toner usage of an image processing device (or fleet of image processing devices) is excessive as will be discussed hereinafter with respect to FIGS. 5-11.

This process can continue for an unlimited duration and the information associated with the events detected and/or generated by application 114 may be used to advantageously improve the ability of the image processing device 110 to determine whether or not the usage of toner is excessive over a period of time.

The backend server 120 may periodically communicate with one of the image processing device 110 and/or the gateway server in order to generate a time line based on the event data stored therein. The information associated with events 400-450 may be used by the backend server to calculate whether or not there was excessive use. For Toner Bottle A, an application executing on the backend server may use data indicating that, for a particular consumable identifier (barcode A), a toner low signal was received indicating that there was no excessive use. For Toner Bottle B, the application 124 executing on the backend server 120 can generate a record indicating excessive use because Toner Bottle B was replaced prior to receiving a toner low signal. The conclusion reached for Toner Bottle C is the same as Toner bottle A and the conclusion for Toner Bottle D is the same for Toner Bottle B.

The algorithms executed by either application 114 executing on image processing device 110 and/or application 124 executing on backend server 120 for determining whether or not excessive toner usage has occurred with now be discussed with respect to FIGS. 5-11. One advantage of employing the application 124 on backend server to determine whether or not excessive usage is occurring is that the application 124 can advantageously make this determination for a fleet of target image processing devices owned and operated by a single entity. However, in another embodiment, the application 114 executing on a respective image processing device may also advantageously make the fleet-based determination by creating a master-slave relationship where one image processing device is designated the master device and all other devices, for example, on the same network, can be designated slave devices. In this embodiment, the master device can communicate requests for toner event data stored in the memory of each slave device and make the determination as to whether or not there has been excessive use and undue environmental waste across the fleet of image processing devices in the manner discussed through this specification. It should be noted that the identification of slave devices by sensing a presence of other machines on a network is described for purposes of example only and the identification of slave machines may be determined based on a preset configuration identifying all machines owned and operated by an entity. This may include information identifying an address on a network (either local or otherwise) that the image processing devices may be found thus enabling the application executing on the master device to bidirectionally communicate with all other slave devices to make the required fleet-based determination.

In a further embodiment, the event determination, identification, storage and response described above with respect to FIG. 4 may be implemented entirely by application 114 executing on the image processing device. In this embodiment, the event data is stored locally on storage device of the image processing device, the data from which may be used by the application 114 in determining if there is has potentially been excessive toner usage. In doing so, the algorithms described hereinbelow with respect to FIG. 5-11 may represent the instructions stored in a memory of the image processing device that, when executed by one or more processors of the image processing device can perform the operations described herein.

Figure 5:
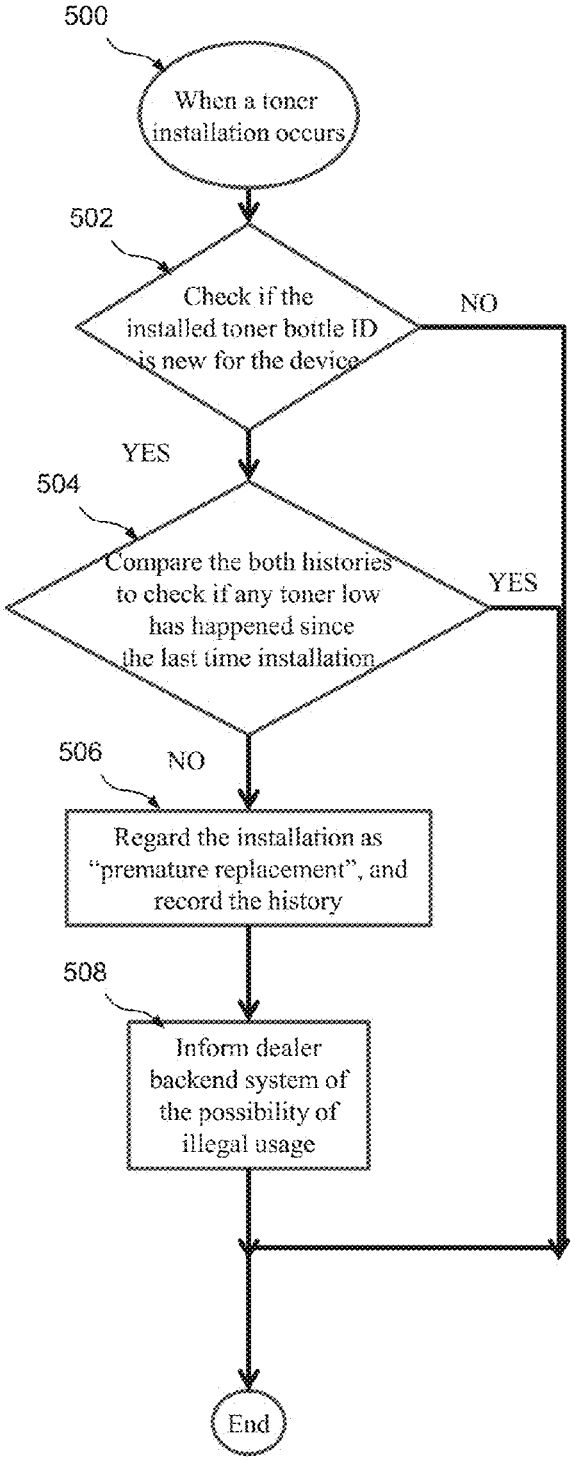
FIGS. 5-11 illustrates exemplary flow diagrams setting forth various algorithms executed by processing devices used to implement monitoring of consumables in at least one image processing device.

FIG. 5 illustrates the algorithm executed when a new toner installation event (400, 420, 430, 440 and 450 in FIG. 4) is detected. In step S500, a new toner installation event is detected by a sensor in the image processing device positioned proximate to an assembly for receiving the toner bottle. In step S502, the application checks to see if the consumable identifier of the toner bottle is an identifier that has previously been stored in device memory. If the result of the query in step S502 is negative, the routine ends. If the result of the query in step S502 is positive, the application determines if a toner low event signal has happened between this installation and a previous toner bottle installation in step S504. If the result in step S504 is positive, the routine ends. If the result of step S504 is negative, the application updates the premature replacement counter in step S506 and one of a dealer and supplier is notified of the premature replacement in step S508.

Figure 6:
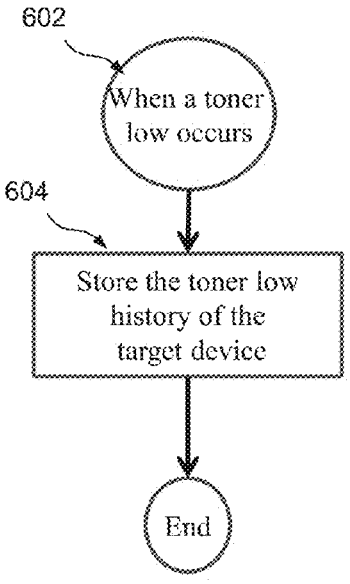

In FIG. 6, when application detects a toner low signal has been generated in step 602 (event 410, 435) the application causes the toner low signal history to be updated in step 604. That history may then be communicated to one of the gateway server 130 and the backend server 120. The result communicated to the gateway server 130 and/or the backend server 120 may be used, in conjunction with the determination that the usage ratio has exceeded a predetermined threshold in reaching a determination that excessive use of toner has occurred.

Figure 7A:
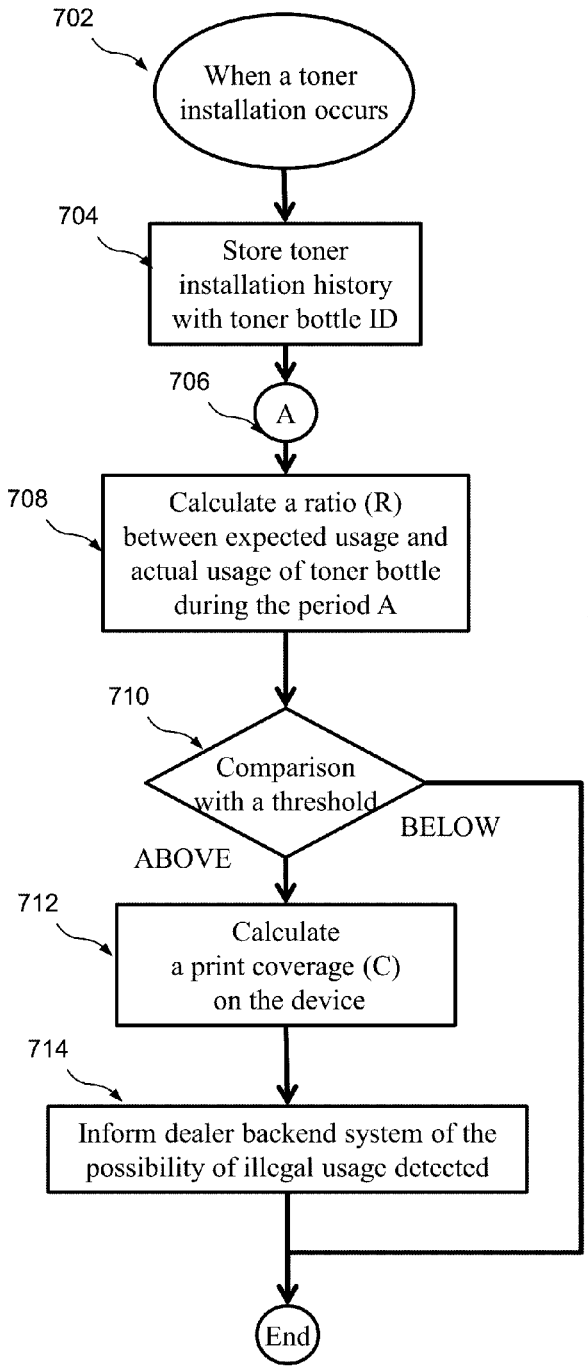
Figure 7B:
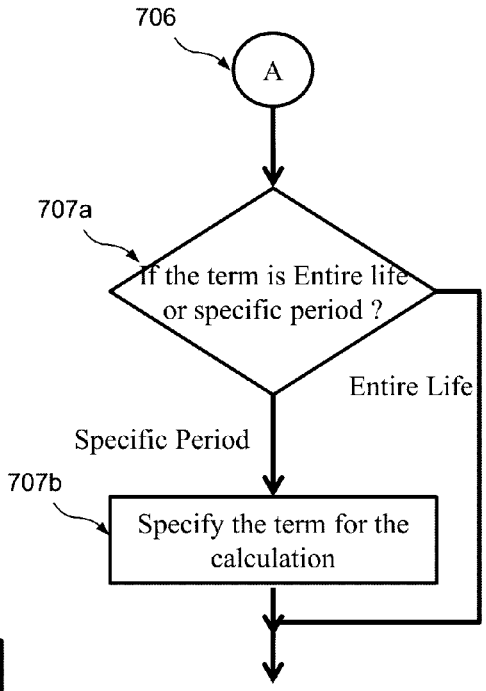

FIGS. 7A and 7B illustrate the algorithm for calculating whether excessive toner usage has occurred. This algorithm may be stored in the memory of either the image processing device 110 or the server 120 and executed by the respective processors thereof. In step 702, an event indicating that a new toner installation has occurred is detected. In step 704, the application updates toner installation history with the consumable identifier associated with the installed toner bottle. In step 706, the application determines the period for calculating excessive usage which is further described in FIG. 7B. In step 707*a* of FIG. 7B, the application queries whether the period is the entire life of the image processing device or a predetermined time period. If the result of 707*a* is the entire life, the process reverts back to FIG. 7A. If the result of the query in step S707*a* is, a specific period, the application requests the user to specify the term for calculating excessive use in step 707*b*. In some embodiments, the term may be automatically provided by a message generated by the backend server or the gateway server and may depend on the terms of use in an agreement between the dealer and the user of the image processing device. In other embodiments, the term may be preconfigured within the application itself.

Returning back to FIG. 7A, in step 708, the application calculates a ratio (R) between expected usage and actual usage of the toner bottle during the period specified in step S706. The result of step 708 is determined by dividing total counter value of the page output counter during the period by a yield value to obtain an estimate number of used toner bottles. The yield value is a constant value identifying an number of pages able to be output for a particular toner bottle. Thereafter, the actual number of toner bottles used during the period is divided by the estimated number of used bottles to obtain the excessive ratio (r). The value of the excessive ratio (R) is compared to a threshold in step S710. If the result of the comparison in S710 is the value of (R) is below the threshold, the routine ends and the application indicates that no excessive use has occurred. If the result of the comparison in S710 is the value of (R) being above the threshold, a print coverage value is calculated in step S712 and the dealer is informed of possible excessive use of toner in step S714.

In one embodiment, the algorithm described in FIGS. 7A & 7B, may be implemented periodically or on a predetermined date and time. In other embodiments, the algorithm may be triggered in response to detecting one of (a) a toner low signal; (b) a no toner signal; (c) a bottle replacement signal indicative of a toner bottle being removed from the image processing device; and (d) a same toner installation signal indicating that an installation of a toner bottle included replacement of a previously identified toner bottle with the same bottle having the same identifier. The algorithms described above can also be implemented on one or more image processing devices to determine whether or not a fleet of image processing devices has exceeded an allotted toner usage amount.

Figure 8:
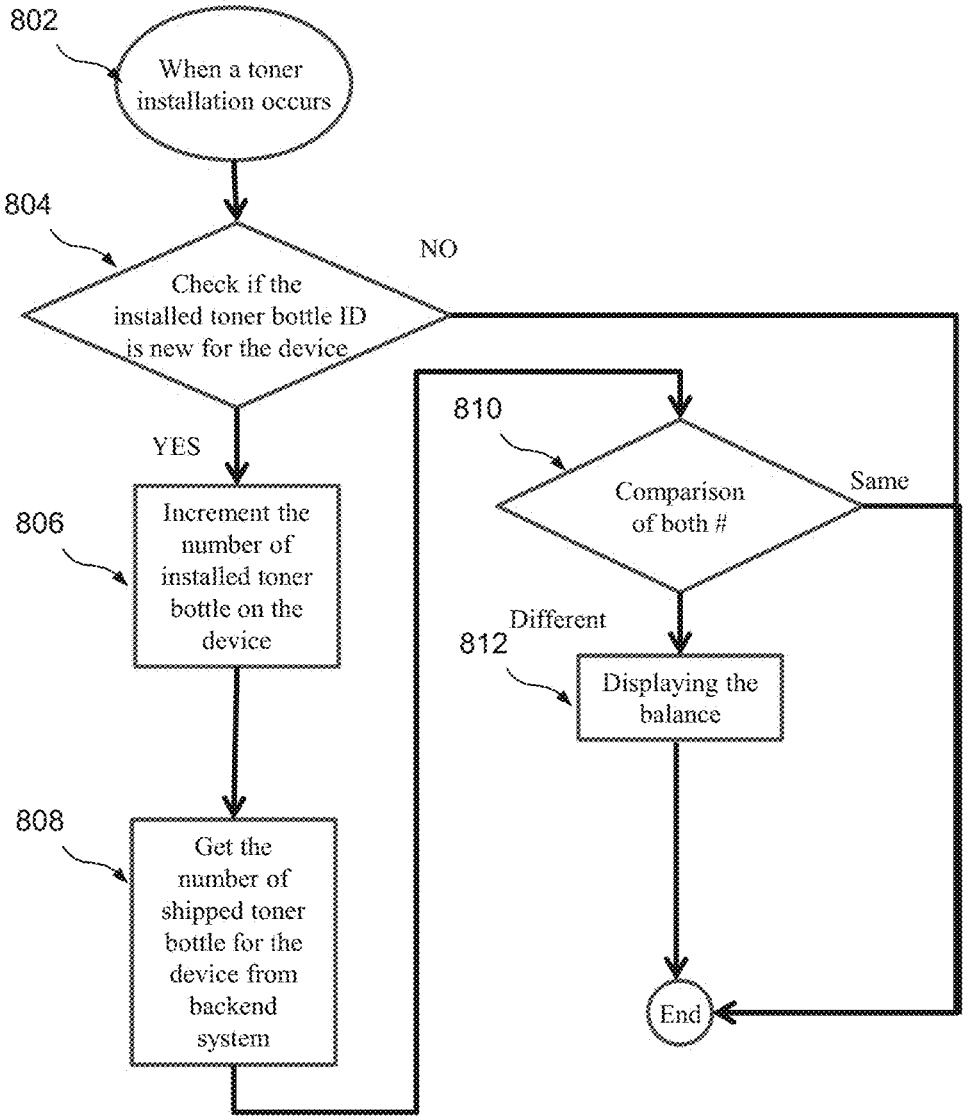

Other embodiments for determining whether or not excessive toner usage has occurred will now be described with respect to FIGS. 8-11. In FIG. 8, after detection of new toner installation event in step S802, the application determines whether or not the toner bottle is newly installed for the respective image processing device. If the result is negative, the process ends. If the result in step S802 is positive, the application increments a number of installed toner bottles on the image processing device in step S804. In step S806, a number of shipped toner bottles is acquired by the image processing device from a data store in the backend server 120. In step 808, a number of installed toner bottles is compared to a number of shipped toner bottles. If the result is the same (number installed=number shipped), the routine ends. If the result is different, the balance of toner bottles shipped but not installed is displayed or otherwise output to the user in step S810.

Figure 9:
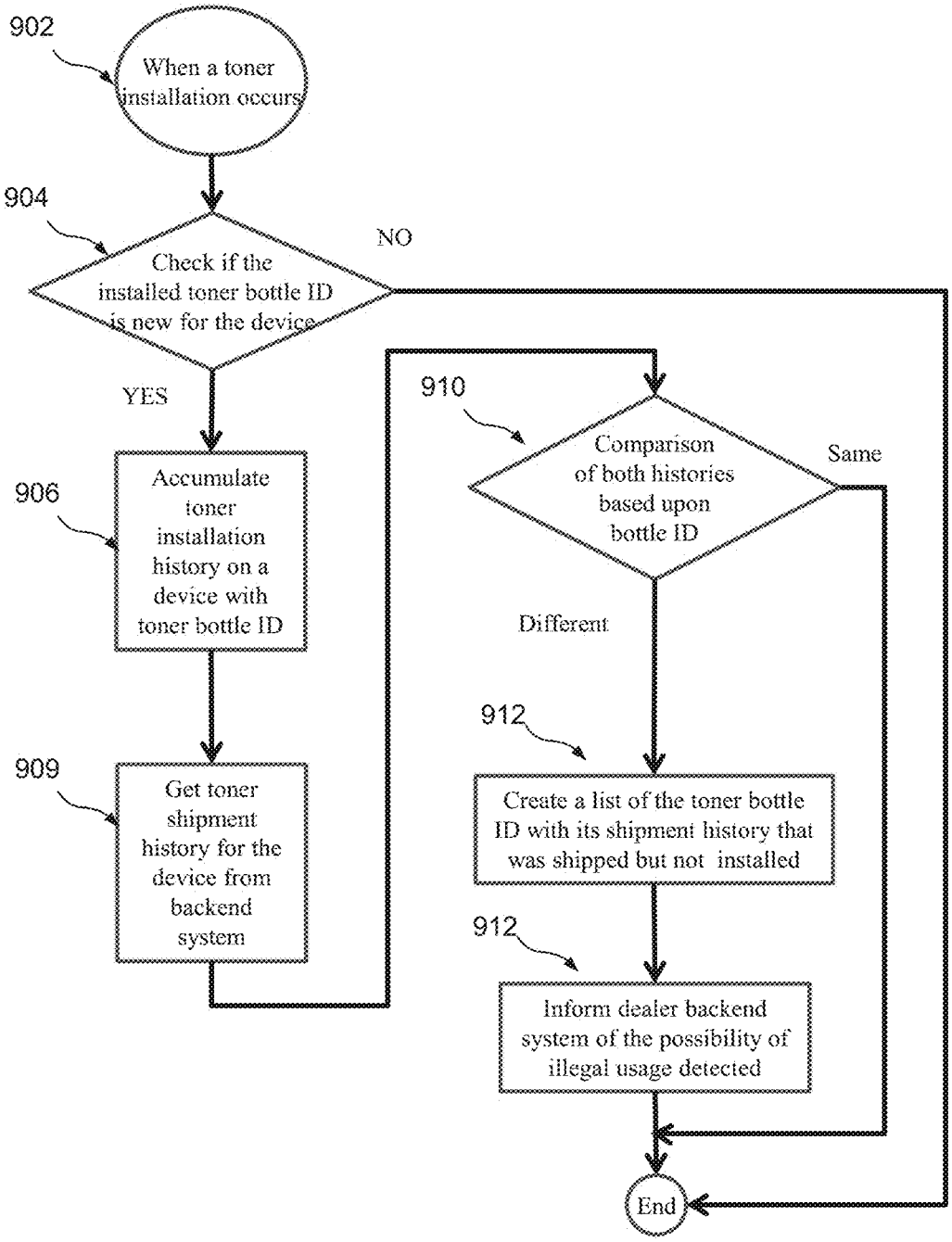

FIG. 9 illustrates an algorithm for determining excessive toner usage based on the process described in FIG. 8. In step S902, a toner installation event is detected. In step S904, the application checks of the newly installed toner bottle had been previously been installed. If the result of S904 is negative, the routine ends. If the result of S904 is positive, then in step S906, the application updates toner installation history on the image processing device. In step S908, the image processing device acquires shipment history for the device from the backend server. In step S910, the shipment history and installation history is compared based on the toner bottle IDs in each. If the histories show the same bottles shipped and installed, the routine ends. If there is a difference, in step S912, the application generates a list of toner bottle IDs that were shipped but not installed. In step S914, a message indicating usage of toner bottles for particular device conflicts with at least one term of use is generated and communicated to the dealer.

Figure 10:
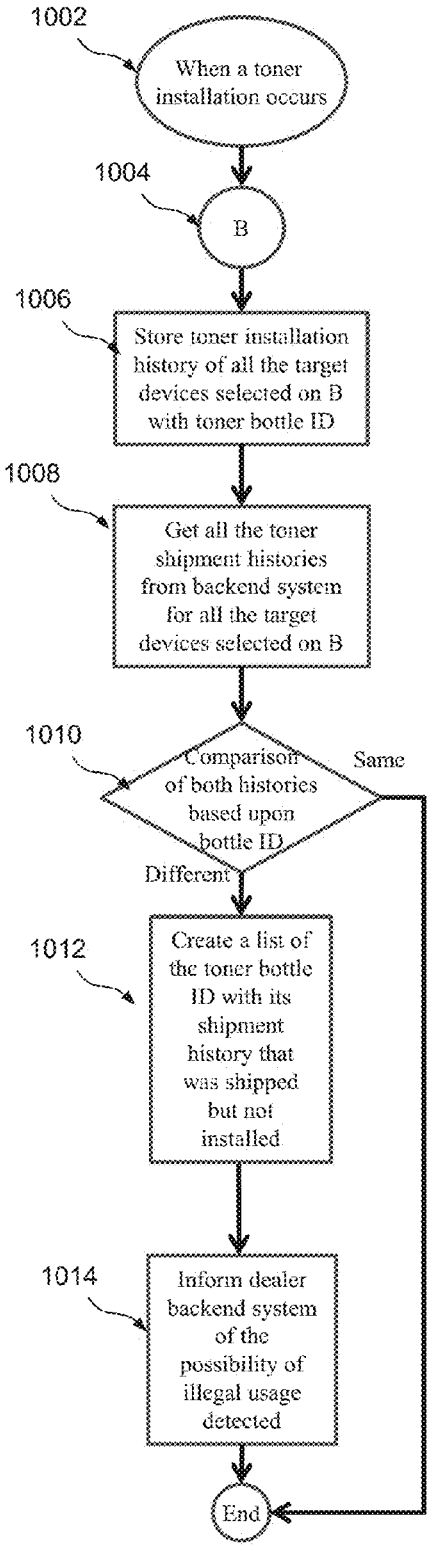
Figure 11:
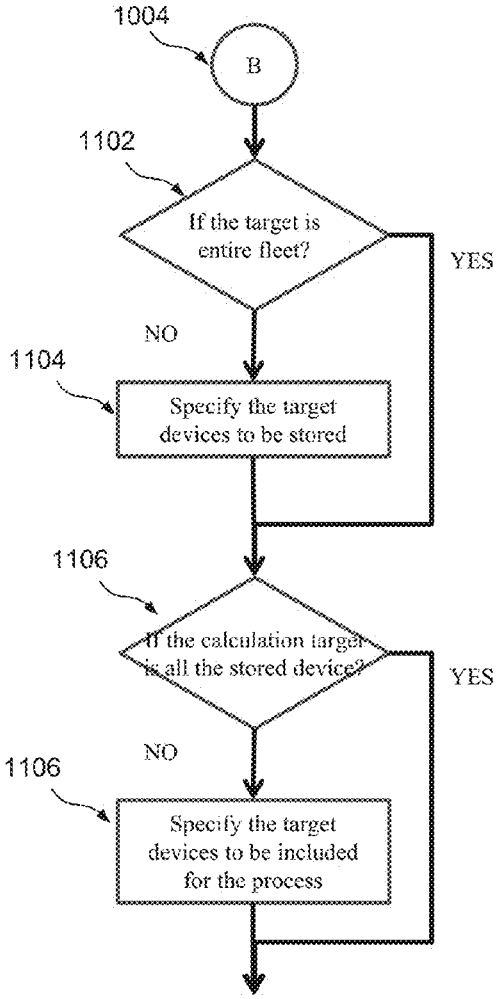

FIGS. 10 and 11 describe an exemplary process for detecting a number of unused toner bottles across a fleet of image processing devices. In step 1002, a toner installation event is detected. In step S1004, the application determines a number of image processing devices for which information is required. The steps that comprise S1004 in FIG. 10 are described in FIG. 11.

In step S1102, the application determines whether or not every device in the fleet of image processing devices should be included. If the result is positive, the routine continues at step S1106. If the result is negative, the user is asked to specify the target device for which information should be stored in step S1104. In other embodiments, the target devices may be specified in advance based on configuration data stored in the application and/or provided by one of the gateway server 130 or backend server 120. In step 1106, the application determines whether the calculation of excessive usage should be made for all devices selected in step S1104 or the entire fleet. If the result is positive, the routine reverts back to FIG. 10. If the result is negative, the user is asked to specify the target devices to be included in the calculation.

Referring back to FIG. 10, the toner installation history including toner bottle identifiers of all target devices is stored in step S1006. In step S1008, the toner shipment histories for all devices is acquired and a comparison of the installation histories and the shipment histories is made in step S1010. If the result of the comparison is the same (installed bottles=to shipped bottles), the routine ends. If the result of the comparison in S1010 is different, a list of toner bottles shipped but not installed is generated in step S1012 and communicated to the dealer in S1014.

The above described algorithm advantageously enables calculation a ratio (R) between the expected number of used toner bottle and the actual number of used toner bottle on a device by store a toner installation history with unique ID of the installed toner bottle on the device. The storing process includes storing timestamp data and checking if the installed toner bottle ID already exists in the history, to put a label as new or not in the history based upon the result of the previously executed check.

The ratio (R) can be calculated between the expected number of used toner bottle and the actual number of used toner bottle on the device. The expected number of used toner bottle is calculated by usage page count and Lifetime count of the toner bottle and the ratio (R) is compared with a preconfigured threshold. The results the comparison may be communicated with a toner ordering system (e.g. dealer's ERP system). Further, if the ratio (R) excesses the threshold, the app has a means to calculate and to output a print coverage (C) on the device and output an indication that excess usage has occurred. In one exemplary embodiment, a print coverage value may be obtained using a page coverage measurement algorithm which selectively measures a total amount of the page that is being output by the image processing device that is covered with toner. In another embodiment, the print coverage value may be obtained by using a dot count measurement algorithm which measures the number of dots of toner/ink that is deposited on the page. These are described for purposes of example only and any mechanism or algorithm that is able to determine an amount of toner or ink that has been affixed to a particular page output by the image processing device may be used.

In other embodiments, the algorithm advantageously acquires toner shipment information with unique ID of the toner bottle from the toner ordering system and compares them with the unique IDs on the toner replacement histories in order to output information identifying any difference of the two (like the toner bottle IDs that are shipped but not installed.)

In an embodiment, where the calculation includes multiple image processing devices, the algorithm advantageously calculates an average ratio (AR) calculated from a set of the ratio (R) on each target device of the target fleet. The actual number of used toner bottle on each device, page count on each device and Lifetime count of the toner bottle are used in this calculation. The average ratio (AR) is compared with a preconfigured threshold and if the average ratio (AR) exceeds the threshold, the print coverage of the device is calculated and output.

Various above-described operations performed by the image processing device 110 may be executed and/or controlled by one or more applications running on the image processing device 110. The above description serves to explain principles of the invention; but the invention should not be limited to the examples described above. For example, the order and/or timing of some of the various operations may vary from the examples given above without departing from the scope of the invention. Further by way of example, the type of network and/or computing systems may vary from the examples given above without departing from the scope of the invention. Other variations from the above-recited examples may also exist without departing from the scope of the invention.

Any applicable computer-readable medium (e.g., a magnetic disk (including a floppy disk, a hard disk), an optical disc (including a CD, a DVD, a Blu-ray disc), a magneto-optical disk, a magnetic tape, and semiconductor memory (including flash memory, DRAM, SRAM, a solid state drive, EPROM, EEPROM)) can be employed as a computer-readable medium for the computer-executable instructions. The computer-executable instructions may be stored on a computer-readable storage medium that is provided on a function-extension board inserted into a device or on a function-extension unit connected to the device, and a CPU provided on the function-extension board or unit may implement at least some of the operations of the above-described embodiments.

The scope of the claims is not limited to the above-described embodiments and includes various modifications and equivalent arrangements. Also, as used herein, the conjunction "or" generally refers to an inclusive "or," though "or" may refer to an exclusive "or" if expressly indicated or if the context indicates that the "or" must be an exclusive "or."

We claim:

1. An image processing device comprising:

a detector detects at least one characteristic associated with a consumable container installed in the image processing device;

a counter selectively increments count data indicative of a number of pages having a consumable applied thereto that have been output by the image processing device;

one or more processors; and one or more computer-readable storage media coupled to the one or more processors, the one or more computer-readable media storing at least one application including instructions that, when executed by the one or more processors, cause the one or more processors to calculate a usage ratio representing an expected number of used consumable bottles and an actual number of used consumable bottles using the at least one characteristic detected by the detector and the count data;

determine whether the usage ratio exceeds a usage threshold, and communicate a result of the determination when the usage ratio exceeds the usage threshold.

2. The image processing device according to claim 1, wherein the at least one characteristic detected by the detector includes a first characteristic representing a unique identifier associated with a toner container, and the application compares the detected unique identifier to a set of previously detected unique identifiers;

determines that the consumable container is an initial installation when the detected unique identifier does not match one of the set of previous detected unique identifiers; and increments a container counter value in response to the determination.

3. The image processing device according to claim 2, wherein in response to determining that the consumable container is an initial installation, the application obtains, from an output counter, a output total value representing a number of total pages output by the image processing device at the time of the installation of the consumable container, and sets, in memory, the obtained output total value as a baseline for use in calculating the usage ratio.

4. The image processing device according to claim 3, wherein the at least one characteristic detected by the detector includes a second characteristic representing a consumable low signal, and the application sets, in memory, a flag indicating the issuance of the consumable low signal for the installed consumable container, and determines that excess usage has occurred using the set flag and the result that the calculated usage ratio has exceeded the threshold; and communicates the excess usage determination to a user.

5. The image processing device according to claim 1, wherein the application calculates the usage ratio over a predetermined time period by obtaining a total output value representing a total number of pages output over the predetermined period;

dividing the total output value by a yield value representing an expected number of pages able to be output using the consumable in the consumable container to obtain an estimated consumable container value;

identifying a total number of consumable containers installed over the predetermined time period;

dividing the total number of consumable containers by the estimated consumable container value to obtain the usage ratio value.

6. The image processing device according to claim 1, wherein the application communicates, via a network, the result to a supplier of consumable containers.

7. The image processing device according to claim 1, wherein the application calculates a print coverage value in response to, for each page output by the image processing device, data identifying a type of page output, determines excessive consumable use based on the print coverage value and the usage ratio exceeding the threshold value.

8. The image processing device according to claim 7, wherein the type of page output includes identifies, for each page output by the image processing device, at least one of (a) a type of pattern output on a page; (b) a quality associated with a pattern output on a page; and (c) a number of different types of consumables used in outputting the page.

9. A method for determining excessive consumable usage executing on an image processing device, the method comprising:

detecting at least one characteristic associated with a consumable container installed in the image processing device;

selectively incrementing count data indicative of a number of pages having a consumable applied thereto that have been output by the image processing device;

calculating a usage ratio representing an expected number of used consumable bottles and an actual number of used consumable bottles using the at least one characteristic detected by the detector and the count data;

determine whether the usage ratio exceeds a usage threshold, and communicate a result of the determination when the usage ratio exceeds the usage threshold.

10. The method according to claim 9, wherein the at least one characteristic detected by the detector includes a first characteristic representing a unique identifier associated with a toner container, the method further comprising comparing the detected unique identifier to a set of previously detected unique identifiers;

determining that the consumable container is an initial installation when the detected unique identifier does not match one of the set of previous detected unique identifiers; and incrementing a container counter value in response to the determination.

11. The method according to claim 10, further comprising obtaining, in response to determining that the consumable container is an initial installation, from an output counter, a output total value representing a number of total pages output by the image processing device at the time of the installation of the consumable container, and setting, in memory, the obtained output total value as a baseline for use in calculating the usage ratio.

12. The method according to claim 11, wherein the at least one characteristic detected by the detector includes a second characteristic representing a consumable low signal, and further comprising setting, in memory, a flag indicating the issuance of the consumable low signal for the installed consumable container, and determining that excess usage has occurred using the set flag and the result that the calculated usage ratio has exceeded the threshold; and communicating the excess usage determination to a user.

13. The method according to claim 9, wherein the usage ratio is calculated over a predetermined time period by obtaining a total output value representing a total number of pages output over the predetermined period;

dividing the total output value by a yield value representing an expected number of pages able to be output using the consumable in the consumable container to obtain an estimated consumable container value;

identifying a total number of consumable containers installed over the predetermined time period;

dividing the total number of consumable containers by the estimated consumable container value to obtain the usage ratio value.

14. The method according to claim 9, further comprising calculating a print coverage value, based on each page output by the image processing device, data identifying a type of page output; and determining excessive consumable use based on the print coverage value and the usage ratio exceeding the threshold value.

15. The method according to claim 14, wherein the type of page output includes identifies, for each page output by the image processing device, at least one of (a) a type of pattern output on a page; (b) a quality associated with a pattern output on a page; and (c) a number of different types of consumables used in outputting the page.

16. A non-transitory computer-readable medium storing instructions that, when executed by one or more processors, cause the one or more processors to perform operations comprising:

detecting at least one characteristic associated with a consumable container installed in the image processing device;

selectively incrementing count data indicative of a number of pages having a consumable applied thereto that have been output by the image processing device;

calculating a usage ratio representing an expected number of used consumable bottles and an actual number of used consumable bottles using the at least one characteristic detected by the detector and the count data;

determine whether the usage ratio exceeds a usage threshold, and communicate a result of the determination when the usage ratio exceeds the usage threshold.

17. A server in communication with at least two image processing devices via a network, the server comprising:

one or more processors; and one or more computer-readable media coupled to the one or more processors, the one or more computer-readable media store instructions that, when executed by the one or more processors, cause the one or more processors to, receiving device-specific data from each of the at least two image processing devices, the device specific data including at least one characteristic associated with consumable containers in each of the at least two image processing device;

calculate, for each of the at least two image processing devices, a device usage ratio representing an expected number of used consumable containers and an actual number of used consumable containers;

calculating the collective usage ratio by aggregating each calculated device usage ratio to determine whether the collective usage ratio exceeds a usage threshold, and communicating a result of the determination when the collective usage ratio exceeds the usage threshold.

18. A method of determining excessive usage of a consumable across at least two image processing devices, the method comprising:

A server in communication with at least two image processing devices via a network, the server comprising:

receiving device-specific data from each of the at least two image processing devices, the device specific data including at least one characteristic associated with consumable containers in each of the at least two image processing device;

calculate, for each of the at least two image processing devices, a device usage ratio representing an expected number of used consumable containers and an actual number of used consumable containers;

calculating the collective usage ratio by aggregating each calculated device usage ratio to determine whether the collective usage ratio exceeds a usage threshold, and communicating a result of the determination when the collective usage ratio exceeds the usage threshold.

* * * * *